US009675125B1

(12) United States Patent
Whitney

(10) Patent No.: US 9,675,125 B1
(45) Date of Patent: Jun. 13, 2017

(54) HEADWEAR AND METHOD OF CREATING CUSTOM HEADWEAR

(71) Applicant: Carlotta Fatima Whitney, Lorain, OH (US)

(72) Inventor: Carlotta Fatima Whitney, Lorain, OH (US)

( * ) Notice: Subject to any disclaimer, the term of this patent is extended or adjusted under 35 U.S.C. 154(b) by 0 days.

(21) Appl. No.: 14/754,661

(22) Filed: Jun. 29, 2015

Related U.S. Application Data

(60) Provisional application No. 62/017,983, filed on Jun. 27, 2014.

(51) Int. Cl.

| | |
|---|---|
| ***A41G 3/00*** | (2006.01) |
| ***A41D 23/00*** | (2006.01) |
| ***A45D 7/00*** | (2006.01) |
| ***B05D 5/06*** | (2006.01) |

(52) U.S. Cl.
CPC ..... *A41D 23/00* (2013.01); *A45D 7/00* (2013.01); *B05D 5/06* (2013.01); *A41G 3/00* (2013.01); *A45D 2007/002* (2013.01)

(58) Field of Classification Search
CPC . A41D 23/00; B05D 5/06; A45D 7/00; A45D 40/30; A45D 44/14; A45D 44/005; A45D 2007/002; A41G 3/00; A41G 3/0041; A41G 3/0075; A41G 5/004; A42C 99/00; A42B 1/004; A42B 1/24; A42B 1/248; B44B 2700/021; B44B 1/02; B44B 3/001; A61F 2/10
USPC ... 132/201, 212, 213, 214, 333, 319, 53–56; 434/94, 371; 623/15.11
See application file for complete search history.

(56) References Cited

U.S. PATENT DOCUMENTS

| | | | | |
|---|---|---|---|---|
| 2,803,829 | A * | 8/1957 | Tscharner | A42B 1/004 2/181 |
| 3,421,521 | A * | 1/1969 | Rich, Jr. | A41G 3/00 132/201 |
| 4,297,724 | A * | 10/1981 | Masuda | A45D 44/005 348/586 |
| 4,317,462 | A * | 3/1982 | Steiner | A45D 24/36 132/213 |
| 4,370,137 | A * | 1/1983 | Herzig | A45D 44/005 434/94 |
| 4,731,743 | A * | 3/1988 | Blancato | A45D 44/005 345/632 |
| 5,465,426 | A * | 11/1995 | Beaton | A42B 1/248 2/181 |
| 5,906,005 | A * | 5/1999 | Niskala | G03C 5/04 2/173 |
| 5,937,081 | A * | 8/1999 | O'Brill | G06T 11/00 345/632 |
| 6,311,332 | B1 * | 11/2001 | Lien | A42B 1/248 2/175.1 |
| 6,719,565 | B1 * | 4/2004 | Saita | A45D 44/005 428/42.3 |
| 6,994,552 | B2 * | 2/2006 | Hirata | A45D 44/005 345/419 |

(Continued)

*Primary Examiner* — Rachel Steitz

(57) ABSTRACT

Provided are a garment to be worn on a human head and a method of creating a garment to be worn on a human head. The method includes creating a desired hair pattern on a head of a model, and optically capturing an image of the desired hair pattern. The captured image is then printed or otherwise applied onto a region of material sized to be worn on the human head of a person who is to wear the garment.

5 Claims, 1 Drawing Sheet

(56) References Cited

U.S. PATENT DOCUMENTS

| | | | | |
|---|---|---|---|---|
| 7,483,763 | B2 * | 1/2009 | Dilbeck, Jr. | G06T 19/00 345/156 |
| 2007/0227551 | A1 * | 10/2007 | Gold | A41G 5/0033 132/201 |
| 2008/0011313 | A1 * | 1/2008 | Gildenberg | A41G 3/0075 132/56 |
| 2010/0000562 | A1 * | 1/2010 | Cho | A41G 5/004 132/201 |
| 2012/0046873 | A1 * | 2/2012 | Rabin | A61N 5/0617 702/19 |
| 2012/0118315 | A1 * | 5/2012 | Goff | B41J 3/407 132/201 |
| 2012/0271650 | A1 * | 10/2012 | Ahn | G06Q 50/22 705/2 |

* cited by examiner

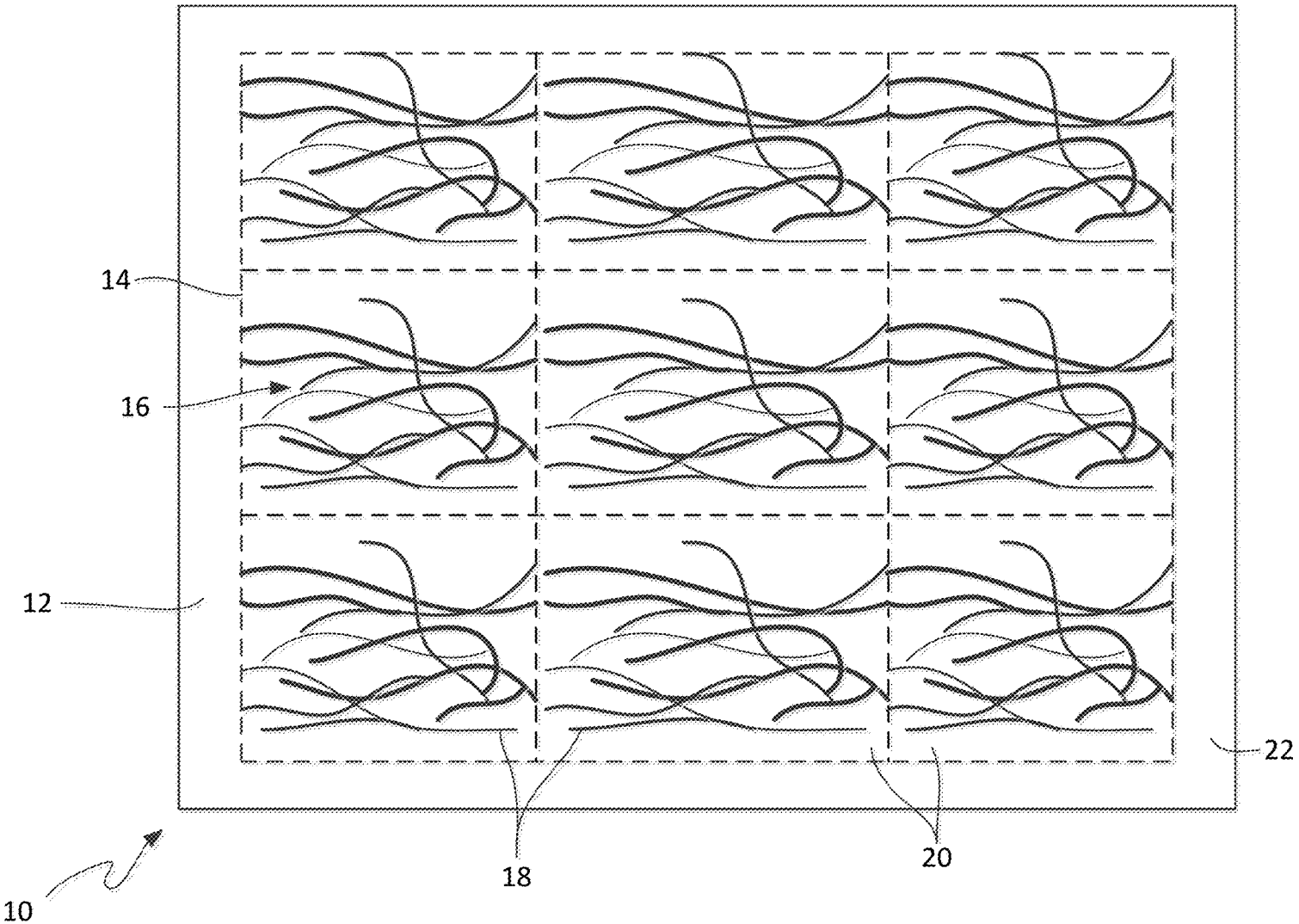
22
20
18
14
16
12
10

HEADWEAR AND METHOD OF CREATING CUSTOM HEADWEAR

CROSS-REFERENCE TO RELATED APPLICATIONS

This application claims the benefit of U.S. Provisional Application No. 62/017,983, filed Jun. 27, 2014, which is incorporated in its entirety herein by reference.

BACKGROUND OF THE INVENTION

1. Field of the Invention

This application relates generally to headwear and a method of producing headwear and, more specifically, to headwear with an exterior surface having a pattern of human hair for creating the appearance of hair on a region of a human head that has been adversely affected by trauma, a medical condition and/or medical treatment, and any other condition that has interfered with the formation of a desire hair pattern.

2. Description of Related Art

Patients suffering from medical conditions such as cancer will often lose some or all of their hair in response to undergoing chemotherapy treatments. Hair loss occurs because the chemotherapy treatments target living cells in the body that rapidly divide, which specifically includes air follicles. Thus, patients who are fighting cancer may also wear hats in public to conceal hair loss. However, wearing a hat may appear out of place indoors, and may not be a familiar look for cancer patients who infrequently wore hats before being treated for cancer.

BRIEF SUMMARY OF THE INVENTION

Accordingly, there is a need in the art for headwear that provides those wearing it with the appearance of human hair, and optionally the appearance of the wearer's own hair as it appeared prior to the wearer being afflicted with a medical condition.

According to one aspect, the headwear and its method of production solves the cosmetic emergency of any head, neck and shoulder trauma causing a disfigurement, loss of hair, or the need to have a covering over the head, neck and shoulder. The headwear can have an exterior surface with an appearance resemblying any of countless hair styles, which can be printed (e.g., inkjet, screen printed, etc.) or otherwise applied on different materials such as, cloth silk, cotton, knitted and all such materials that can be worn on head, neck, and shoulders. The headwear can take any form, such as head scarves, neck scarves, hats etc., providing the wearer with a natural hair-stylish look.

According to one aspect, the subject application involves a method of creating a garment to be worn on a human head. Such a method includes creating a desired hair pattern on a head of a model, and optically capturing an image of the desired hair pattern. The captured image is then applied onto a region of material sized to be worn on the human head of a person who is to wear the garment.

The above summary presents a simplified summary in order to provide a basic understanding of some aspects of the systems and/or methods discussed herein. This summary is not an extensive overview of the systems and/or methods discussed herein. It is not intended to identify key/critical elements or to delineate the scope of such systems and/or methods. Its sole purpose is to present some concepts in a simplified form as a prelude to the more detailed description that is presented later.

BRIEF DESCRIPTION OF SEVERAL VIEWS OF THE DRAWING

The invention may take physical form in certain parts and arrangement of parts, embodiments of which will be described in detail in this specification and illustrated in the accompanying drawings which form a part hereof and wherein:

FIG. 1 shows a view of an exposed surface of a garment to be worn on a human head.

DETAILED DESCRIPTION OF THE INVENTION

Certain terminology is used herein for convenience only and is not to be taken as a limitation on the present invention. Relative language used herein is best understood with reference to the drawings, in which like numerals are used to identify like or similar items. Further, in the drawings, certain features may be shown in somewhat schematic form.

It is also to be noted that the phrase "at least one of", if used herein, followed by a plurality of members herein means one of the members, or a combination of more than one of the members. For example, the phrase "at least one of a first widget and a second widget" means in the present application: the first widget, the second widget, or the first widget and the second widget. Likewise, "at least one of a first widget, a second widget and a third widget" means in the present application: the first widget, the second widget, the third widget, the first widget and the second widget, the first widget and the third widget, the second widget and the third widget, or the first widget and the second widget and the third widget.

A garment 10, shown in FIG. 1, to be worn on a human head and a method of creating a garment to be worn on a human head are set forth herein. The garment 10 includes a piece of material 12 suitable for wearing, such as silk, cotton, woven and knitted materials, blends thereof, and any other type of fabric. The material 12 is flexible and foldable, and can be wrapped at least partially about a human head and tied or otherwise held in place thereon. The material can include a region 14 (outlined using broken lines) onto which a desired hair pattern 16 is printed or otherwise applied as an image.

The hair pattern 16 can be created by printing the same, repeating pattern 18 representing a subsection of the overall hair pattern 16 within a plurality of subsections 20 (represented as a grid of broken lines, which may or may not be visible on the exposed surface of the region 14) that are arranged within the region 14 to be positioned at various predetermined locations of the human head when the garment 10 is being worn. The hair pattern 16 can represent any pattern into which human hair is styled, and can include style elements such as weaves, curls, straight hair, braids, etc. According to alternate embodiments, the repeating pattern 18 can optionally be symmetrically arranged about the region 14 to be shown as left and right sides, for example, when the garment 10 is being worn on the human head.

Once the pattern 16 has been applied to the material 12, one, a plurality, or optionally all of the subsections 20 collectively forming the region 14 can be cut from a border region 22 or other remainder portion of the material that will not form a portion of the finished garment 10. The border region 22 can be left blank (e.g., not subjected to the printing process applying the pattern 16), or can include the printed pattern 16.

To create the garment 10, the desired hair pattern 16 can be designed on paper (e.g., drawn by hand), formed using suitable image rendering computer software executing on a suitably-programmed computer terminal, received over a wide area network (e.g., the Internet) as part of a submission from a remote computer terminal, sculpted, or otherwise created in any other manner. The desired hair style can be colored to achieve any desired hair pattern. The desired hair pattern should include at least one of a front, rear, left side and right side regions of the desired hair pattern.

Regardless of how the desired hair pattern 16 is formed, it can be transferred to, sculpted on, printed on, or otherwise applied to the head of a model (e.g., the head of a mannequin). For embodiments where the front, rear, left side and right side of the hair pattern are created, each respective side should be transferred or otherwise applied to the corresponding region on the model's head. Images (e.g., digital photographs) of the transferred hair pattern can be obtained using a digital camera or other optical image capturing device. Capturing the image from the model's head allows contours of the hair pattern conforming to the model's head to be realized in the image of the pattern 16 that is subsequently printed onto the region 14 of the material 12, which is sized to be worn on the human head of the person who is to wear the garment.

According to alternate embodiments, photographs of the wearer's actual hair can be captured using the image capture device prior to the loss of hair. For such embodiments, the steps of transferring the image to the model's head can be omitted because the contours of the hair pattern will be captured directly from that person's head.

Illustrative embodiments have been described, hereinabove. It will be apparent to those skilled in the art that the above devices and methods may incorporate changes and modifications without departing from the general scope of this invention. It is intended to include all such modifications and alterations within the scope of the present invention. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A method of creating a garment to be worn on a human head, the method comprising:

creating a desired hair pattern on a head of a model;

optically capturing an image of the desired hair pattern; and printing the image captured a plurality of times in a repeating pattern onto a region of a sheet of fabric material sized to be wrapped at least partially about the human head of a person who is to wear the garment.

2. The method of claim 1, wherein said creating the desired hair pattern comprises styling real hair on the human head prior to experiencing hair loss.

3. The method of claim 2, wherein said optically capturing the image comprises taking a digital photograph of the real hair after said styling.

4. The method of claim 1 further comprising cutting the region from a remainder portion of the material to establish a desired size of the garment for the human head on which it is to be worn.

5. The method of claim 1, wherein said creating the desired hair pattern comprises receiving, over a communication network from a remote computer terminal, an image representing the desired hair pattern as part of a network transmission.

* * * * *